US007526839B2

(12) United States Patent
Yang

(10) Patent No.: US 7,526,839 B2
(45) Date of Patent: May 5, 2009

(54) STRUCTURE OF AN OUTER BUTTON

(76) Inventor: Shih-Sheng Yang, No. 124, Wu Kung 2nd Rd., Wu Ku Hsiang, Taipei Hsien (TW)

( * ) Notice: Subject to any disclaimer, the term of this patent is extended or adjusted under 35 U.S.C. 154(b) by 219 days.

(21) Appl. No.: 11/559,907

(22) Filed: Nov. 15, 2006

(65) Prior Publication Data

US 2007/0101553 A1 May 10, 2007

Related U.S. Application Data

(63) Continuation-in-part of application No. 10/943,900, filed on Sep. 20, 2004, now abandoned.

(51) Int. Cl.
*A44B 17/00* (2006.01)
*A44B 11/25* (2006.01)

(52) U.S. Cl. ..... 24/104; 24/90.1

(58) Field of Classification Search ..... 24/90.1, 24/94, 95, 104, 114.4, 114.05
See application file for complete search history.

(56) References Cited

U.S. PATENT DOCUMENTS 1,229,452 A * 6/1917 Heineman ..... 24/104
2,058,020 A * 10/1936 Jaffe ..... 24/114.4
4,967,452 A * 11/1990 Watanabe et al. ..... 24/94
5,107,573 A * 4/1992 Zhang ..... 24/104
5,173,997 A * 12/1992 Takezawa et al. ..... 24/104
6,618,909 B1 * 9/2003 Yang ..... 24/94

* cited by examiner

*Primary Examiner*—Robert J Sandy
(74) *Attorney, Agent, or Firm*—Leong C. Lei

(57) ABSTRACT

An improved button structure which includes a pillar element and a zinc casting body. The pillar element is provided with a hollow cylinder at the bottom and an expanding disk, which is provided with pluralities of through holes, on the top. The zinc casting body is provided with a smooth plane at the upper surface, and pluralities of engaging posts, which have positioning portions, at the bottom surface. The through holes of the pillar element are mounted on the engaging posts of the zinc casting body, such that the pillar element can be positioned at the positioning portions of the engaging posts and further mortised to lock to the top end of the engaging posts which extrude out of the disk to form blunt heads to accomplish a firm combination, thereby enhancing the benefit in production.

3 Claims, 5 Drawing Sheets

STRUCTURE OF AN OUTER BUTTON

CROSS-REFERENCE

This is a continuation-in-part of the patent application Ser. No. 10/943,900, filed Sep. 20, 2004 now abandoned.

BACKGROUND OF THE INVENTION (a) Technical Field of the Invention

The present invention relates to an improvement in the structure of an outer button, particularly to a button, the surface of which is formed with a specific trademark specimen by metallurgy injection via metal powder. The processed button surface is further combined with a copper pillar element. The copper, which is soft in its specific physical characteristic, in combined with the button surface, can be extensively applied to clothing articles.

(b) Description of the Prior Art

In order to freely change the outer style or brand a logo on the surface, the surface of the conventional buttons used to be made of plastic material or formed via plastic injection, and then combined with a pillar element to accomplish a button structure. However, as the bearing of a production made of plastic is less than that of metal, the conventional buttons have less endurance.

In respect of metal buttons, the surface element is made of zinc or copper. In view of the higher cost and better extensibility of copper, the post portion mounted at the surface element of said buttons is made of copper, whereas the surface element of the buttons is made of zinc. The combination of said two materials concerns the manufacture cost and efficiency, the stability of the product quality, etc.

The inventor has previously disclosed U.S. Pat. No. 6,618,909, which relates to a child-proof button. The body portion and tubular portion of said button are combined together via mortise lock technology. However, the combined structure is different from that of the present invention, wherein no rotation would occur after the pillar element and the body element combine.

SUMMARY OF THE INVENTION

The primary object of the invention is to provide an improvement in the structure of an outer button, which is composed of the easily casting zinc and highly extensible copper, thereby simplifying the process, enhancing the manufacture efficiency, reducing the manufacture cost, etc.

The secondary object of the invention is to provide an improvement in the structure of an outer button structure, which can, as conventional buttons, be freely stylized, provided with a trademark specimen on the upper surface for advertisement purposes.

To accomplish the above objects, the improved outer button structure according to the invention is composed of a pillar element and a zinc casting body. The pillar element is provided with a hollow cylinder for coupling purpose and an expanding disk, which is provided with pluralities of through holes, on the top. The surface of the zinc casting body is provided with a specific trademark specimen, while pluralities of engaging posts, which have a step at the middle section, are provided at the bottom surface thereof. The through holes of the pillar element are mounted of the engaging posts of the zinc casting body, such that the pillar element can be, via mechanical process, mortised to lock to the top end of the engaging posts, which extrude out of the disk to form blunt heads to accomplish a firm combination.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following description are of exemplary embodiments only, and are not intendeded to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
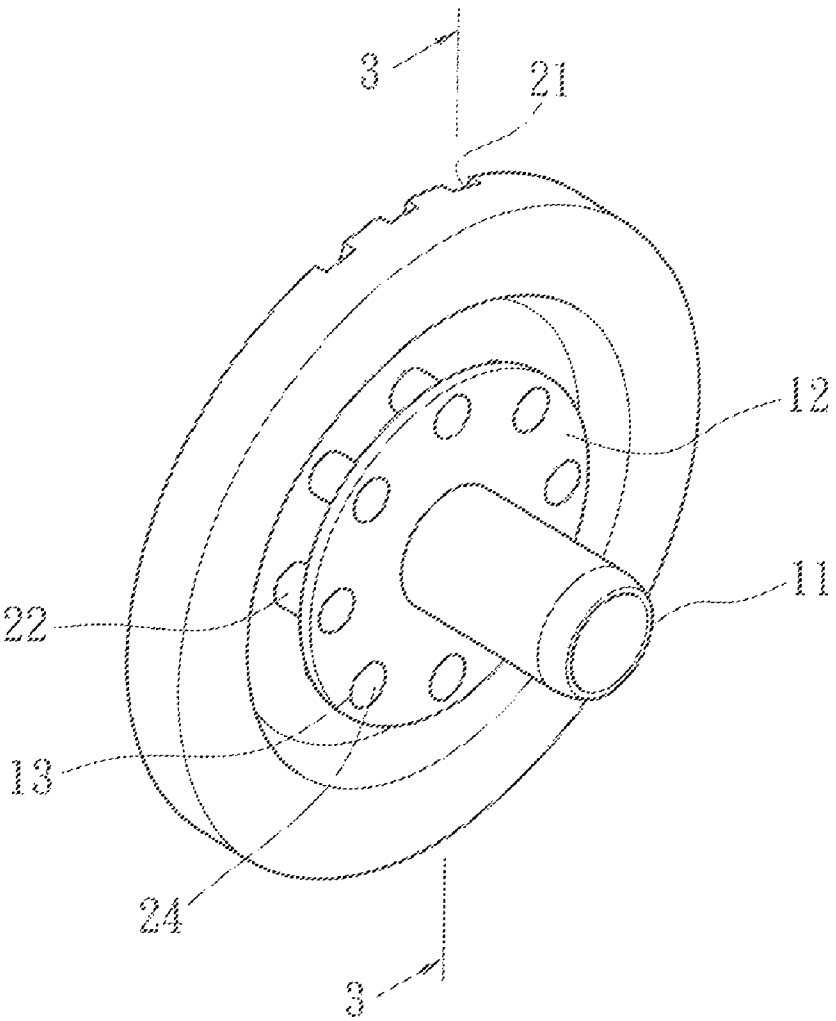
FIG. 1 is a perspective view of the present invention in combination status.
Figure 2:
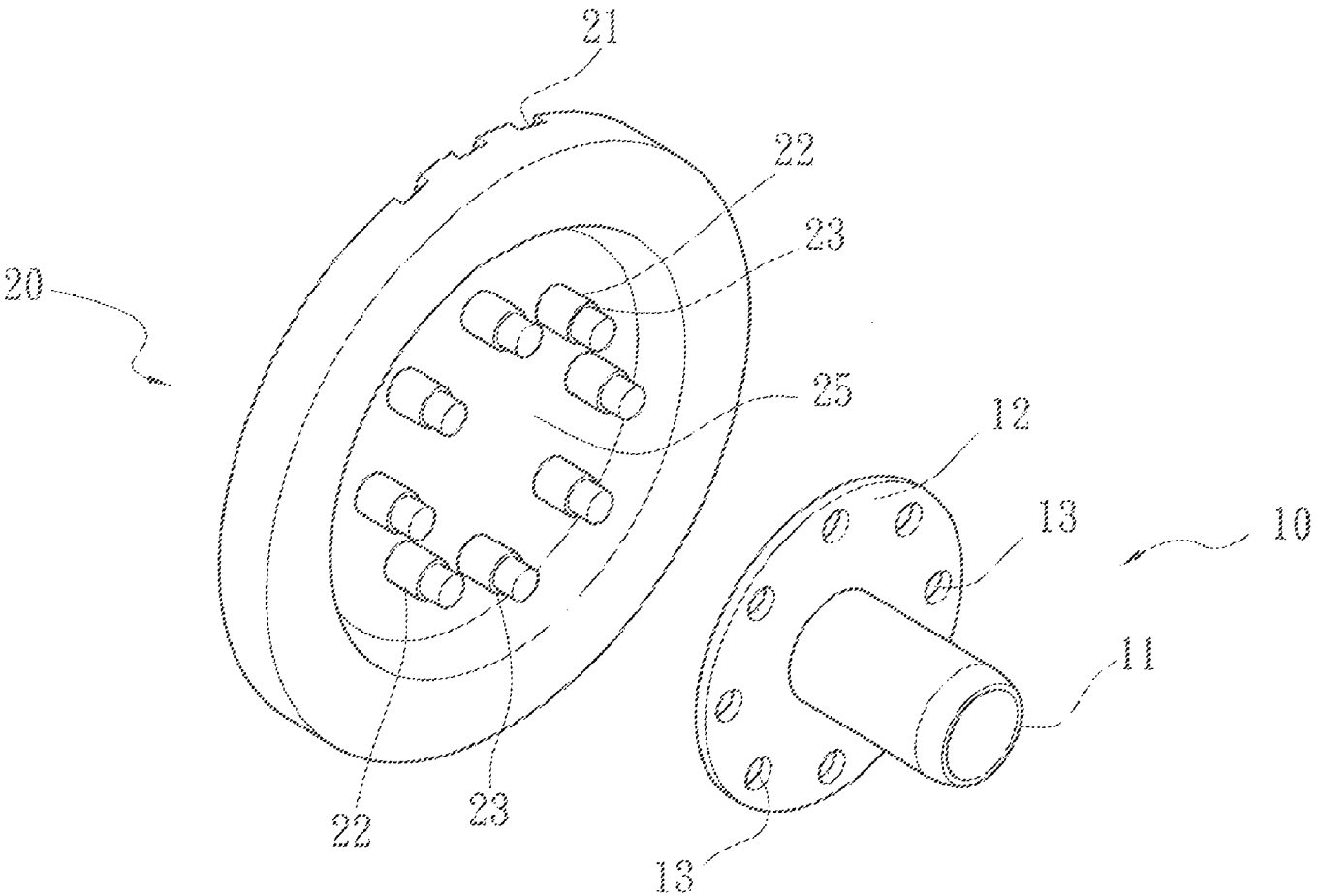
FIG. 2 is an exploded view of the pillar element and zinc casting body of the present invention.
Figure 3:
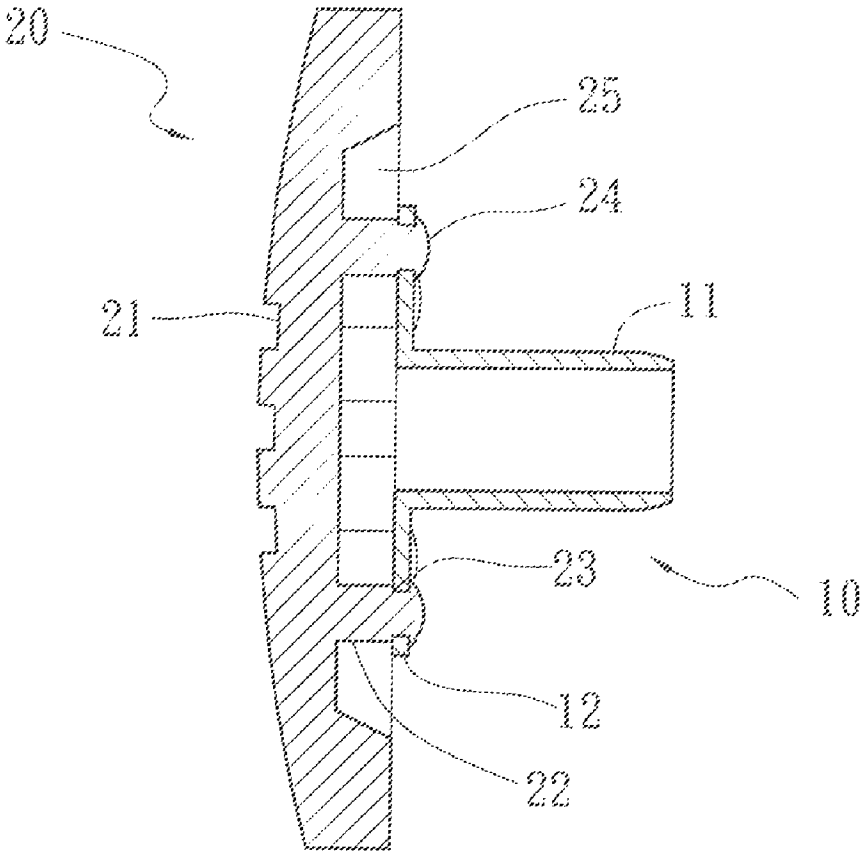
FIG. 3 is a sectional view taken along line 3-3 of FIG. 1.

As shown in FIGS. 1, 2 and 3, the improved outer button according to the present invention primarily comprises a pillar element 10 and a zinc casting body 20.

The pillar element 10 is provided with a hollow cylinder 11 at the bottom and an expanding disk 12 on the top. The expanding disk 12 is provided with a plurality of through holes 13 surrounding the hollow cylinder 11.

The zinc casting body 20, serving as a surface element of the button, is provided with a specific trademark specimen 21 on the smooth plane at the upper surface, and a plurality of engaging posts 22 at the bottom surface. Each of the positioning posts 22 has a positioning step 23, such that the through holes 13 of the pillar element 10 can be positioned in the same level after being mounted thereon. The relatively small bar extending from below of the step 23 of the engaging post 22 must have a height greater than the thickness of the expanding disk 12, such that when the pillar element 10 is combined with the zinc casting body 20, the expanding disk 12 is mounted via the through holes 13 onto the engaging posts 22, and the end of the engaging posts 22 will extrude out of the through holes 13.

According to an embodiment of the present invention, a recession 25 which includes the whole area that the engaging posts 22 are provided. Accordingly, the zinc casting body 20 of the button would present rather thick and solid, but actually more material-efficient. Besides, the zinc casting body 20 becomes lighter in weight.

As shown in FIG. 3, the pillar element 10 is disposed in the central recession 25 at the bottom of the zinc casting body 20. The through holes 13 are mounted with the engaging posts 22, such that the pillar element 10 can be positioned at the step 23 on the positioning portion of the engaging posts 22. The top end of the engaging post 12 extruding out of the expanding disk 12 is further mortised to form a blunt head 24 for a firm combination purpose.

Figure 4:
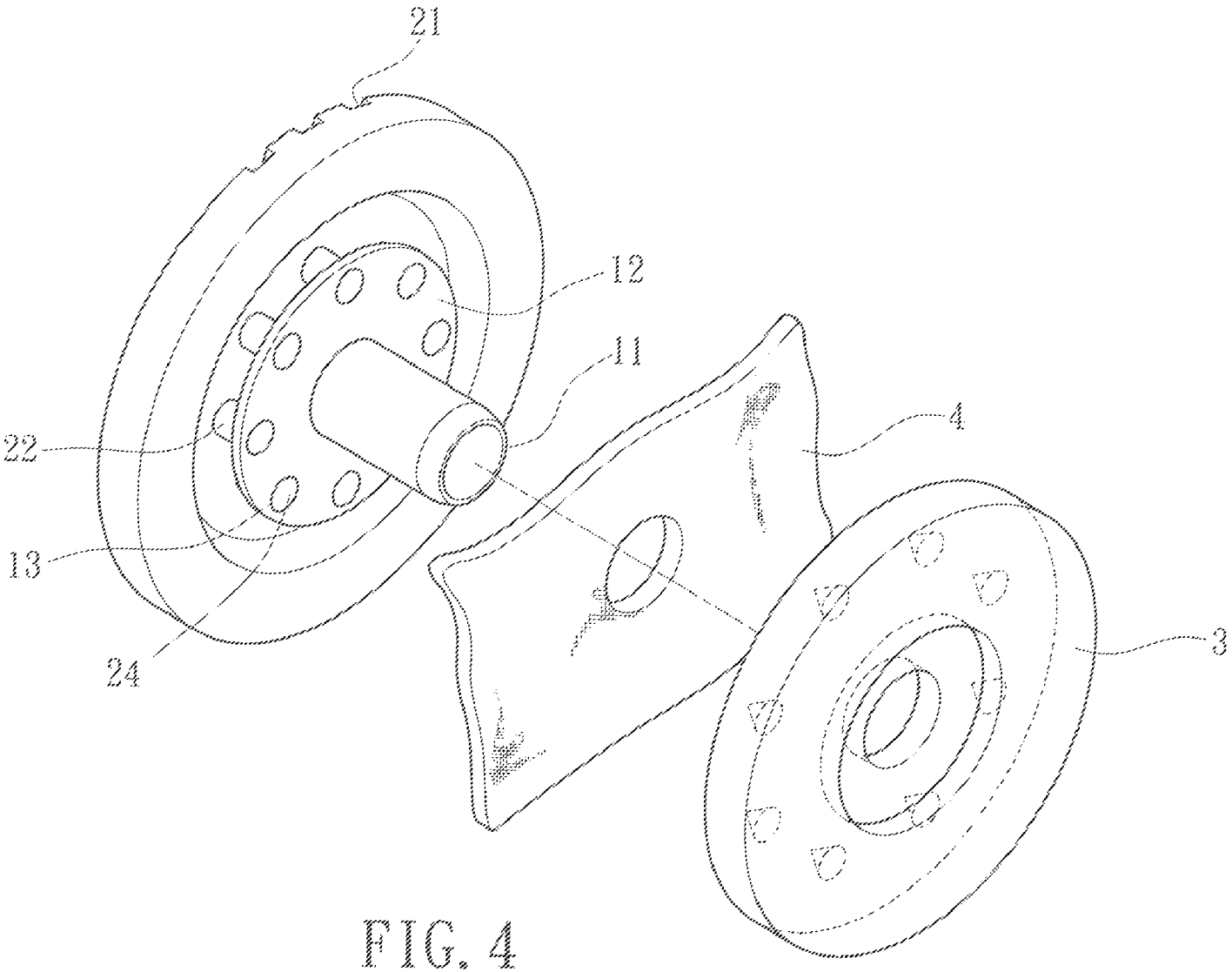
FIG. 4 is an exploded view showing the relationship between the pillar element, the zinc casting body and the inner button.
Figure 5:
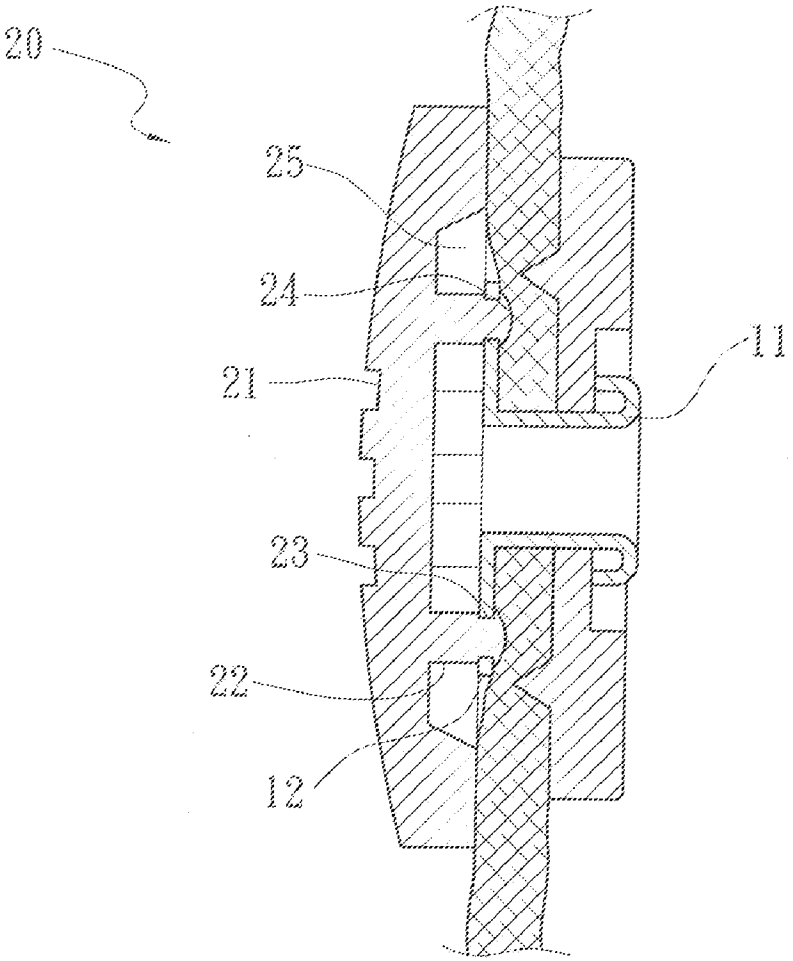
FIG. 5 is a sectional view showing the engagement among the pillar element, the zinc casting body, the clothing article and the inner button.

Referring to FIGS. 4 and 5, when in use, a piece of clothing article 4 is arranged between the outer button according to the present invention and an inner button 3, the hollow cylinder 11 is inserted through the clothing article 4 and the inner button 3, and then the outer end of the hollow cylinder 11 is riveted on the outer side of the inner button 3.

It is worth a mention that the position portion of the engaging post 22 shown in the shown embodiment can be a bar with various diameters, such that a step can be formed. Alternatively, the engaging posts 22 can be provided as tapers, such that the through holes 13 of the expanding disk 12 can be locked on middle section of the engaging posts 22 after being mounted thereon, to obtain the same positioning purpose. The pluralities of through holes 13 provided on the expanding disk 12 of the pillar element 10 and the pluralities of engaging posts 22 provided at the zinc casting body 20 are identical in amount. Provided the number of the engaging posts 22 is half of the through holes 13, the position of each engaging post 22 must be correspondingly set in between each two through holes 13, such that said two elements can be mounted to combine.

Accordingly, the present invention has following advantages:

a. The present invention is related to a structural design of a decorative button. The surface of the button is the apparent focus attention of one's outfit, and it is usually branded with a logo, design, or color drawing. The button surface of conventional button structure can be easily damaged during the mechanical process—locking the pillar element to the central engaging post via mortising, as the pressure is centered on the engaging post while mortising. As for the present invention, a plurality of engaging posts 22 are engaged with the through holes 13 in the process of mortising, so that the pressure can be evenly spread out on the surface thereby causing less damages to the button surface.

b. The button according to the present invention is not intended to pass through articles of clothing; instead it's for the purpose of branding a logo onto the button surface. Combining pluralities of engaging posts 22 with through holes 13 via mortising results in a firm combination with strong enforcement and high torsion value, it's not possible to be taken apart. While the post portion mounted at the surface element of said buttons is made of copper—soft in its specific physical characteristic, the surface element of the buttons is made of zinc. The combination of the said two materials allow the buttons to be made thinner in width and lighter in weight and are less likely to get damaged during mortising.

c. When mounting the engaging posts 22 with the through holes 13 for the button according to the present invention, the mounting centers at somewhere close to the middle of the said buttons, which is different than conventional button structures with mounting centering on the outer rim of the buttons. With mounting centers on the outer rim of the buttons, the buttons have to be made thicker in width for the mechanical process. Therefore, the present invention of the improved button structure has the advantage of being lighter in weight and thinner in width. This advantage increase the suitability of buttons for different occasions, such that it could be buttons on the vamp of shoes, pockets of backpacks, articles of clothing for decorative purposes, and/or even articles of underwear . . . etc.

Concluded above, the novel button structure of the invention can enhance manufacture quantity and efficiency, reduce manufacture cost, reinforce the combination force of the button, apply to articles of various pattern and style, adopt trademark specimen on the button surface, etc.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a button structure comprising an inner button, an outer button and a piece of clothing article arranged between said inner button and said outer button, the improvement wherein said outer button comprises a pillar element and a zinc casting body, said pillar element having a first end provided with an expanding disk, said expanding disk being provided with a plurality of through holes, said zinc casting body having a first side provided with a smooth plane and a second side provided with a recession, said recession being provided with a plurality of engaging posts, each of said engaging posts being provided with a positioning step, said through holes of said pillar elements being engaged with engaging posts of said zinc casting body thereby causing said pillar element to be positioned on said positioning step of said engaging posts which extend out of said through holes of said expanding disk and are mortised to lock to a top end of said engaging posts to form blunt heads to accomplish a firm combination, said piece of clothing article being arranged between said outer button and said inner button, said hollow cylinder being inserted through said clothing article and said inner button and an outer end of said hollow cylinder being riveted on an outer side of said inner button.

2. The button structure as claimed in claim 1, wherein said engaging posts of said zinc casting body are tapered.

3. The button structure according to claim 1, wherein said through holes provided on said expanding disk of said pillar element and said engaging posts provided at said zinc casting body are identical in amount.

* * * * *